United States Patent [19]

Kita et al.

[11] Patent Number: 4,915,864

[45] Date of Patent: Apr. 10, 1990

[54] AQUEOUS SOLUTION COMPOSITION OF STRONG ALKALI AND NONIONIC SURFACE ACTIVE AGENT

[75] Inventors: Kazuo Kita; Etsuko Morimi; Toshimasa Hamai, all of Wakayama, Japan

[73] Assignee: Kao Corporation, Tokyo, Japan

[21] Appl. No.: 205,992

[22] Filed: Jun. 13, 1988

[30] Foreign Application Priority Data

Jun. 25, 1987 [JP] Japan ..... 62-158682
Nov. 9, 1987 [JP] Japan ..... 62-28342

[51] Int. Cl.[4] ..... C11D 1/10; C11D 1/66

[52] U.S. Cl. ..... 252/117; 252/108; 252/132; 252/156; 252/DIG. 14; 252/546

[58] Field of Search ..... 252/108, 117, 546, 156, 252/132, DIG. 14

[56] References Cited

U.S. PATENT DOCUMENTS

| | | | |
|---|---|---|---|
| 2,802,715 | 8/1957 | Hofer et al. | 8/139 |
| 3,437,598 | 4/1969 | De Voldre et al. | 252/156 |
| 3,653,095 | 4/1972 | Dupre et al. | 252/156 |
| 4,048,121 | 9/1977 | Chang | 252/527 |
| 4,212,760 | 7/1980 | Baur et al. | 252/156 |
| 4,349,448 | 9/1982 | Steele | 252/135 |
| 4,364,777 | 12/1982 | Grünert et al. | 139/29 |
| 4,382,825 | 5/1983 | McCready | 134/2 |
| 4,390,465 | 6/1983 | Spekman | 252/527 |
| 4,416,792 | 11/1983 | Blackstone | 252/110 |
| 4,443,363 | 4/1984 | Klinger et al. | 252/547 |
| 4,556,504 | 12/1985 | Rek | 252/135 |
| 4,597,888 | 7/1986 | King | 252/135 |

FOREIGN PATENT DOCUMENTS

| | | |
|---|---|---|
| 120533 | 10/1984 | European Pat. Off. . |
| 47496 | 4/1981 | Japan . |
| 47499 | 4/1981 | Japan . |

*Primary Examiner*—Prince E. Willis
*Attorney, Agent, or Firm*—Oblon, Spivak, McClelland, Maier & Neustadt

[57] ABSTRACT

An aqueous solution composition of a strong alkali and a nonionic surface active agent comprising: (a) a strong alkali, (b) a nonionic surface active agent having an HLB value of 3–18, and, as a solubilizing agent, (c) a specific type of carboxylic acid is disclosed. The composition contains a strong alkali and a nonionic surface active agent having an HLB value usually of 3–18 at high concentrations and stably and is homogeneous and transparent. Thus, it is useful for a variety of applications requiring both alkalinity and detergency, for example, as wettability promoting agents of glass, fiber, metal, and earthenware surfaces as well as various toiletry products.

7 Claims, No Drawings

AQUEOUS SOLUTION COMPOSITION OF STRONG ALKALI AND NONIONIC SURFACE ACTIVE AGENT

BACKGROUND OF THE INVENTION

1. Field of the Invention

This invention relates to an aqueous solution of a strong alkali and a nonionic surface active agent, and, more particularly to an aqueous solution composition of a strong alkali and a nonionic surface active agent having an HLB value of 3–18 at high concentrations and stably.

2. Description of the Background

Strong alkalis, for example, sodium hydroxide, potassium hydroxide, sodium orthosilicate, and sodium metasilicate, are used for such applications as neutralization of an acid, saponification reactions of oils and fats (triglycerides), and the like. Also, these alkalis are useful in various industrial applications because of their good electric conductivity. Nonionic surface active agents, on the other hand, are very useful as effective ingredients or detergency improvers of various kinds of detergent compositions owing to their emulsifying, dispersing, and foaming capabilities, as well as to their permeability. They are also effective as wettability promoting agents of glass, fiber, metal, and earthenware surfaces. Because of these characteristics, nonionic surface active agents are widely used in industries in general and for various toiletry products.

Therefore, a combination of a strong alkali and a nonionic surface active agent is expected to produce a composition which is strongly alkaline and at the same time exhibits a high degree of functionality in terms of emulsifying, dispersing, and foaming capabilities, and of permeability.

Preparing an aqueous solution containing both a strong alkali and a nonionic surface active agent at high concentrations, however, has been extremely difficult. Because of this, when a strong alkali and a nonionic surface active agent have to be used together, it has been necessary to supply a solid material in a powdery or flaky form containing a strong alkali and a nonionic surface active agent, or to first supply a strong alkali and a nonionic surface active agent separately as liquids, and then blend the two liquids together when used.

Handling a strong alkali in a powdery or flaky form, however, involves difficulties in actual operation. For example, there is the risk of splashing or generating a mist of the strong alkali in the air. The splashing or misting causes problems in view of human safety and sanitation. For instance, they produce considerable irritation when coming into contact with the skin. Blending liquids of a strong alkali and a nonionic surface active agent is a cumbersome task in itself. In addition, adjusting the concentration of each component requires complicated control.

Due to this situation, the development of an aqueous solution containing both a strong alkali and a nonionic surface active agent at high concentrations has been strongly desired.

A certain action due to a salting-out effect owing to loss of hydration water necessary for dissolving a nonionic surface active agent, which results from dissociated ions of an inorganic strong alkali, has generally been considered to be the cause of the difficulty in preparing this type of strong alkali-nonionic surface active agent aqueous solution.

The present inventors have undertaken extensive studies to eliminate the occurrence of this kind of action, and found that the use of a specific type of carboxylic acid or the salts thereof, as a solubilizing agent, is effective in achieving this target. Such a finding has led to the completion of this invention.

SUMMARY OF THE INVENTION

Accordingly, an object of this invention is to provide an aqueous solution composition of a strong alkali and a nonionic surface active agent comprising: (a) a strong alkali, (b) a nonionic surface active agent having an HLB value of 3–18, and, as a solubilizing agent, (c) a carboxylic acid represented by the following formula (I):

$$R_1COOM_1 \quad (I)$$

in which $R_1$ represents a $C_{4-18}$ linear aliphatic hydrocarbon group, $C_{4-18}$ branched aliphatic hydrocarbon group, or $C_{6-18}$ aromatic hydrocarbon group, and $M_1$ represents a hydrogen atom, an alkali metal, an aliphatic amine having a $C_{1-4}$ carbon atom content, ammonia, or an alkanolamine; or a carboxylic acid of formula (I) and a carboxylic acid of the following formula (II):

$$R_2—X—(CH_2)_{m1}COOM_2 \quad (II)$$

in which $R_2$ represents a $C_{4-18}$ linear aliphatic hydrocarbon group, $C_{4-18}$ branched aliphatic hydrocarbon group, or $C_{6-18}$ aromatic hydrocarbon group, X represents a group $>NH$, $>N(CH_2)_{n1}COOM_2$, or $>CHCOOM_2$, $M_2$ represents a hydrogen atom, an alkali metal, an aliphatic amine having a $C_{1-4}$ carbon atom content, ammonia, or an alkanolamine, and m1 and n1 independently indicate integers of 1–3.

Other objects, features and advantages of the invention will hereinafter become more readily apparent from the following description.

DETAILED DESCRIPTION OF THE INVENTION AND PREFERRED EMBODIMENTS

Any strong alkalis may be used as the (a) component of this invention, so long as the same is water soluble. Specific examples may include sodium hydroxide, potassium hydroxide, sodium silicates such as sodium orthosilicate and sodium metasilicate, sodium phosphates such as sodium tripolyphosphate, sodium orthophosphate, and sodium metaphosphate, aqueous ammonium, ethylenediamine, alkanolamines having a $C_{2-10}$ carbon atom content, and the like. The amount of this (a) component to be formulated in the aqueous solution composition of this invention is 3–50% by weight (hereinafter designated simply as "%"), with the especially preferable range being 5–30%. It is desirable that the formulated amount bring the pH of the composition to at least 10.

Any type of nonionic surface active agent having an HLB value of between 3 and 18 may be used as the (b) component. Given as examples of such nonionic surface active agents are polyoxyethylene alkyl ether, polyoxyethylene alkylaryl ether, polyoxyethylene alkylamino ether, sorbitane fatty acid ester, polyoxyethylene sorbitane fatty acid ester, polyoxyethylene fatty acid ester, glycerol fatty acid monoor diester, and the like. Especially preferred nonionic surface active agents are those represented by the following formula (III):

$$R_3—O—(CH_2CH_2O)_{n2}(CH_2CH_2CH_2O)_{m2}H \quad (III)$$

in which $R_3$ represents a hydrogen, a $C_{1-18}$ linear aliphatic hydrocarbon group, $C_{1-12}$ branched aliphatic hydrocarbon group, or alkylphenyl group with alkyl group(s) having an aggregate $C_{1-12}$ carbon atom content, and n2 and m2 independently denote integers of 0–60, provided that n2 plus m2 is not less than 1.

Enumerated as specific examples of this type of nonionic surface active agents are polyoxyethylene hexyl ether, polyoxyethylene octyl ether, polyoxyethylene decyl ether, polyoxyethylene lauryl ether, polyoxyethylene palmityl ether, polyoxyethylene myristyl ether, polyoxyethylene stearyl ether, polyoxyethylene oleyl ether, polyoxyethylene tolyl ether, polyoxyethylene xylenyl ether, polyoxyethylene octylphenyl ether, polyoxyethylene nonylphenyl ether, polyoxyethylene decylphenyl ether, polyoxyethylene dodecylphenyl ether, polyoxypropylene, polyoxyethylene-polyoxypropylene copolymer, polyoxyethylene-polyoxypropylene octylphenyl ether, polyoxyethylene-polyoxypropylene nonylphenyl ether, polyoxyethylene-polyoxypropylene decylphenyl ether, polyoxyethylene-polyoxypropylene dodecylphenyl ether, polyoxypropylene octylphenyl ether, polyoxypropylene nonylphenyl ether, polyoxypropylene decylphenyl ether, polyoxypropylene dodecylphenyl ether, polyoxypropylene butyl ether, polyoxypropylene hexyl ether, polyoxypropylene octyl ether, polyoxypropylene dodecyl ether, polyoxypropylene lauryl ether, and the like.

Since nonionic surface active agents must have HLB values of 3–18 in this invention, among the compounds listed above only those having the number of added moles of oxyethylene or oxypropylene meeting this criteria are usable for the purpose of this invention. For instance, polyoxyethylene (50) lauryl ether having 50 moles of added polyoxyethylene is outside the scope of this invention, since this compound has an HLB value of 18.6.

These nonionic surface active agents, which are the (b) component of the aqueous solution composition of this invention, are formulated into the composition in the amount of 0.01–30%, and particularly preferably 0.1–10%.

The carboxylic acid or the salt thereof represented by formula (I) is formulated into the composition of this invention as the solubilizing agent, the (c) component. Alternatively, this carboxylic acid or salt may be used in conjunction with the carboxylic acid or the salt thereof represented by formula (II). Named as examples of carboxylic acids represented by formula (I) are linear saturated fatty acids such as caproic acid, enathic acid, caprylic acid, pelargonic acid, capric acid, undecanoic acid, lauric acid, myristic acid, palmitic acid, margaric acid, stearic acid, lactic acid, valeric acid, and the like; branched saturated fatty acids such as 2-butyl-5-methylpentanoic acid, 2-isobutyl-5-methylpentanoic acid, 4,6-dimethyloctanoic acid, 4,7-dimethyloctanoic acid, 2,3-dimethyloctanoic acid, 2,3-dimethylononanoic acid, 4,8-dimethylononanoic acid, 2-butyl-5-methylhexanoic acid, 2-methylundeccanoic acid, 10-methylundeccanoic acid, 4,4-dimethyldeccanoic acid, 2-ethyl-3-methylnonanoic acid, 2,2-dimethyl-4-ethyloctanoic acid, 2-methyldocosanoic acid, 3-methyldocosanoic acid, (+)-3D-methyldocosanoic acid, 2-propyl-3-methylnonanoic acid, 12-methyltridecanoic acid, 2,2-dimethyldodecanoic acid, 2,3-dimethyldodecanoic acid, 4,10-dimethyldodecanoic acid, 2-butyl-3-methylnonanoic acid, and the like; linear unsaturated fatty acids such as caproleic acid, oleic acid, 9-undecylenic acid, elaidic acid, 10-undecylenic acid, 2-lauroleic acid, pasenic acid, linderic acid, obtusilic acid, 5-lauroleic acid, 11-lauroleic acid, 2-palmitoleic acid, 7-palmitoleic acid, cis-9-palmitoleic acid, zoomaric acid, trans-9-palmitoleic acid, tsuzuic acid, 5-myristleic acid, myristleic acid, petroselinic acid, petrosenilaidic acid, and the like; and branched unsaturated fatty acids such as trans-2-methyl-2-pentenoic acid, trans-4-methyl-3-pentenoic acid, cis-2-methyl-2-hexenoic acid, trans-2-methyl-2-hexenoic acid, 2-methylhexanoic acid, 3,4-dimethyl-3-pentenoic acid, trans-2-methyl-2-heptenoic acid, 3-methyl-2-nonenoic acid, 3-methyl-3-nonenoic acid, 5-methyl-2-undecenoic acid, 2,4-dimethyl-2-decenoic acid, 5,9-dimethyl-2-decenoic acid, 2-methyl-2-dodecenoic acid, (−)-5-methyl-2-tridecenoic acid, L(+)-2,4-dimethyl-2-dodecenoic acid, L(+)-2,5-dimethyl-2-tridecenoic acid, and the like. In addition, carboxylic acids having an aromatic group are included in the formula (I) type carboxylic acids. These are phenylacetic acid, β-phenylpropionic acid, γ-phenylacetic acid, δ-phenylvaleric acid, ϵphenylcapronic acid, ζ-phenylenatic acid, η-phenylcaprylic acid, θ-phenylpelargonic acid, ι-phenylcapric acid, naphthenic acid, toluic acid, and the like.

Given as examples of carboxylic acids of formula (II) are the compounds represented by the following formulae:

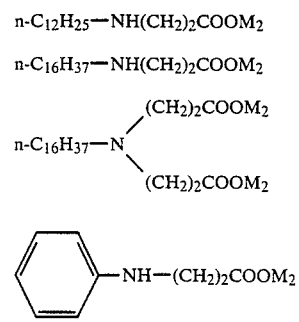

in which $M_2$ has the same meaning as defined before.

Specific examples of $M_1$ and $M_2$ in formulae (I) and (II) are methylamine, ethylamine, propylamine, butylamine, ethylenediamine, diethylenetriamine, ammonia, monoethanolamine, diethanolamine, and triethanolamine, as well as other alkanolamines having a $C_{2-10}$ carbon atom content, sodium, and potassium.

Preferable amounts of these solubilizing agents to be formulated into the composition of the present invention are between 0.01–30%, with the optimum range being 0.1–20%.

Even though there is no specific limitation as to the proportion of the solubilizing agents of formulae (I) and (II) to be formulated when these are used in combination, the preferred range of the proportion in terms of a ratio by weight (I)/(II) is 9/1–1/9, with the optimum ratio being 7/3–3/7.

Aqueous solutions of neutral salts such as sodium sulfate, sodium chloride, hydrosulfite, hypo (sodium thiosulfate), and the like also exhibit salting-out effects on nonionic surface active agents, and thus a single aqueous solution of these compounds is frequently difficult to obtain. Use of the solubilizing agent, however, makes it possible to produce such a single aqueous solution. The action or mechanism of formation of a strong alkali-nonionic surface active agent solution mentioned above applies to the formation of this neutral salt solution.

Formulating an organic chelating-type builder, in addition to the above-mentioned components, is effective in order to promote the detergency capability and other characteristics of the composition of this invention. Included as examples of such organic chelating-type builders are aminocarboxylic acids, inclusive of alkali metal salts or lower amine salts of glycine, nitrilotriacetic acid, ethylenediaminetetracetic acid, diethylenetriaminepentaacetic acid, ethylenediaminediacetic acid, iminodiacetic acid, triethylenetetraminehexaacetic acid, metaphenylenediaminetetraacetic acid, hydroxyethylethylenediaminetriacetic acid, norleucineaminobutylic acid, and the like, and oxycarboxylic acid-type chelating builders such as alkali metal salts or lower ammine salts of malic acid, citric acid, gluconic acid, glucoheptonic acid, mucic acid, and the like.

According to the present invention a strong alkali and nonionic surface active agent can be supplied as a single aqueous solution at a high concentration. This solution is easy and safe to handle, and can provide a strong alkali and nonionic surface active agent having a varied concentration.

Specifically, since the composition is a single aqueous solution, its handling can be performed only through valve manipulation with the fluid being transferred by means of a pump. This eliminates tasks involving danger and improves working conditions.

Other features of the invention will become apparent in the course of the following description of the exemplary embodiments which are given for illustration of the invention and are not intended to be limiting thereof.

EXAMPLES

EXAMPLE 1

The following formula (I) compounds were provided to the test as solubilizing agents:

(a) Caproic acid
(b) Caprylic acid
(c) Capric acid
(d) Lauric acid
(e) Myristic acid
(f) 2-Ethylhexanoic acid
(g) Isostearic acid The capability of each solubilizing agent to solubilize 2% of the nonylphenol ethyleneoxide (9 mols) addition compound and 2% of ethylenediaminetetraacetic acid into a 20% sodium hydroxide (95% first grade reagent) aqueous solution was evaluated. A group of compositions, with amounts of solubilizing agent varied by 0.1%, were prepared for each solubilizing agent. Each composition was stirred for 30 minutes at 30°–40° C. and observed to confirm the presence or absence of turbidity or precipitate to determine the minimum amount of solubilizing agent necessary to inhibit production of any turbidity or precipitant. The results are listed in Table 1.

TABLE 1

| | Solubilizing Agents | | | | | | | | Solubilizing |
|---|---|---|---|---|---|---|---|---|---|
| | (a) | (b) | (c) | (d) | (e) | (f) | (g) | — | Capability |
| Example 1a | 1.2 | | | | | | | | Good |
| Example 1b | | 1.2 | | | | | | | Good |
| Example 1c | | | 1.0 | | | | | | Good |
| Example 1d | | | | 1.0 | | | | | Good |
| Example 1e | | | | | 0.9 | | | | Good |
| Example 1f | | | | | | 1.3 | | | Good |
| Example 1g | | | | | | | 1.3 | | Good |
| Comparative * Example | | | | | | | | | None |

* No solubilizing agent was added to the Comparative Example composition.

The test proves that the additions of the solubilizing agent in the amounts exceeeding those indicated in Table 1 provide a homogeneous and transparent liquid composition.

As is clear from the results, solubilizing agents (a)–(g), even at very small amounts, ensure solubilization of a nonionic surface active agent in an aqueous solution of a strong alkali. In contrast, the alkali and nonionic surface active agent separate and form precipitates without producing a solution when no solubilizing agent is added.

EXAMPLE 2

Table 2 lists values similar to those in Table 1 for solubilizing agents (a)–(g), which designate the minimum amount of each solubilizing agent required to solubilize 2% of the nonylphenol ethyleneoxide (9 mols) addition compound and 2% of ethylenediaminetetraacetic acid into a 20% sodium orthosilicate (90% first grade reagent) aqueous solution.

TABLE 2

| | Solubilizing Agents | | | | | | | | Solubilizing |
|---|---|---|---|---|---|---|---|---|---|
| | (a) | (b) | (c) | (d) | (e) | (f) | (g) | — | Capability |
| Example 2a | 1.1 | | | | | | | | Good |
| Example 2b | | 1.0 | | | | | | | Good |
| Example 2c | | | 0.8 | | | | | | Good |
| Example 2d | | | | 0.7 | | | | | Good |
| Example 2e | | | | | 0.7 | | | | Good |
| Example 2f | | | | | | 1.2 | | | Good |
| Example 2g | | | | | | | 1.2 | | Good |
| Comparative * Example 2 | | | | | | | | | None |

* No solubilizing agent was added to the Comparative Example composition.

The values in Table 2 demonstrates that the addition of very small amounts of solubilizing agents (a)–(g) produce a homogeneous aqueous solution of a nonionic surface active agent and sodium orthosilicate.

EXAMPLE 3

The following compounds were provided for testing as solubilizing agents:

(h) Sodium N-lauryl-β-alanine (a compound of formula (II))
(i) Sodium N-lauryl-β-dialanine (a compound of formula (II))
(j) Caproic acid
(k) Caprylic acid
(l) Capric acid
(m) Lauric acid
(n) Myristic acid
(o) 2-Ethylhexanoic acid
(p) Isostearic acid
(q) γ-Phenylbutylic acid The capability of each solubilizing agent to solubilize 2% of polyoxyethylene nonylphenyl ether (20 mols) addition compound and 2% of ethylenediaminetetraacetic acid into a 30% sodium hydroxide (95% first grade reagent) aqueous solution was evaluated. A group of compositions, with amounts of solubilizing agents varied by 0.1%, were prepared for each solubilizing agent. Each composition was stirred for 30 minutes at 50° C. and observed to confirm the presence or absence of turbidity or precipitate to determine the minimum amount of solubilizing agent necessary to inhibit production of any turbidity or precipitate. The results are listed in Table 3.

TABLE 3

| Composition | Solubilizing Agents (%) | | | | | | | | | | Solution * Conditions |
|---|---|---|---|---|---|---|---|---|---|---|---|
| | (h) | (i) | (j) | (k) | (l) | (m) | (n) | (o) | (p) | (q) | |
| No. 1 | 6.0 | | | | | | | | | | X |
| No. 2 | | 5.0 | | | | | | | | | X |
| No. 3 | 1.2 | | 0.4 | | | | | | | | O |
| No. 4 | 1.2 | | | 0.4 | | | | | | | O |
| No. 5 | 1.2 | | | | 0.3 | | | | | | O |
| No. 6 | 1.2 | | | | | 0.3 | | | | | O |
| No. 7 | 1.2 | | | | | | 0.2 | | | | O |
| No. 8 | 1.2 | | | | | | | 0.5 | | | O |
| No. 9 | 1.2 | | | | | | | | 0.5 | | O |
| No. 10 | 1.2 | | | | | | | | | 0.5 | O |
| No. 11 | | 0.8 | 0.3 | | | | | | | | O |
| No. 12 | | 0.8 | | 0.3 | | | | | | | O |
| No. 13 | | 0.8 | | | 0.3 | | | | | | O |
| No. 14 | | 0.8 | | | | 0.2 | | | | | O |
| No. 15 | | 0.8 | | | | | 0.2 | | | | O |
| No. 16 | | 0.8 | | | | | | 0.5 | | | O |
| No. 17 | | 0.8 | | | | | | | 0.5 | | O |
| No. 18 | | 0.8 | | | | | | | | 0.5 | O |
| No. 19 | | | | | | | | | | | X |

* In the Table "O" designates that the solution is homogeneous and transparent, and "X" designates that the solution is separated.

EXAMPLE 4

The minimum amounts of solubilizing agent required to solubilize 2% of the polyoxyethylene nonylphenyl ether (20 mols) addition compound and 2% of ethylenediaminetetraacetic acid into 30% sodium orthosilicate (90% first grade reagent) aqueous solution were measured for each solubilizing agent used in Example 3 following the same manner as in Example 3. The results are shown in Table 4.

TABLE 4

| Composition | Solubilizing Agents (%) | | | | | | | | | | Solution * Conditions |
|---|---|---|---|---|---|---|---|---|---|---|---|
| | (h) | (i) | (j) | (k) | (l) | (m) | (n) | (o) | (p) | (q) | |
| No. 20 | 5.5 | | | | | | | | | | X |
| No. 21 | | 4.5 | | | | | | | | | X |
| No. 22 | 1.0 | | 0.4 | | | | | | | | O |
| No. 23 | 1.0 | | | 0.4 | | | | | | | O |
| No. 24 | 1.0 | | | | 0.3 | | | | | | O |
| No. 25 | 1.0 | | | | | 0.3 | | | | | O |
| No. 26 | 1.0 | | | | | | 0.2 | | | | O |
| No. 27 | 1.0 | | | | | | | 0.5 | | | O |
| No. 28 | 1.0 | | | | | | | | 0.5 | | O |
| No. 29 | 1.0 | | | | | | | | | 0.4 | O |
| No. 30 | | 0.7 | 0.3 | | | | | | | | O |
| No. 31 | | 0.7 | | 0.3 | | | | | | | O |
| No. 32 | | 0.7 | | | 0.2 | | | | | | O |
| No. 33 | | 0.7 | | | | 0.2 | | | | | O |
| No. 34 | | 0.7 | | | | | 0.2 | | | | O |
| No. 35 | | 0.7 | | | | | | 0.5 | | | O |
| No. 36 | | 0.7 | | | | | | | 0.4 | | O |
| No. 37 | | 0.7 | | | | | | | | 0.3 | O |
| No. 38 | | | | | | | | | | | X |

* In the Table "O" designates that the solution is homogeneous and transparent, and "X" designates that the solution is separated.

Obviously, numerous modifications and variations of the present invention are possible in light of the above teachings. It is therefore to be understood that the scope of the appended claims, the invention may be practiced otherwise than as specifically described herein.

We claim:

1. An aqueous solution composition of a strong alkali and a nonionic surface active agent comprising: (a) a strong alkali, (b) a nonionic surface active agent having an HLB value of 3–18, and, as a solubilizing agent, (c) a carboxylic acid represented by the following formula (I):

$$R_1COOM_1 \quad (I)$$

in which $R_1$ represents a $C_{4-18}$ linear aliphatic hydrocarbon group, $C_{4-18}$ branched aliphatic hydrocarbon group, or $C_{6-18}$ aromatic hydrocarbon group, and $M_1$ represents a hydrogen atom, an alkali metal, an aliphatic amine having a $C_{1-4}$ carbon atom content, ammonia, or an alkanolamine, and a carboxylic acid of the following formula (II), in combination:

$$R_2—X—(CH_2)_{m1}COOM_2 \quad (II)$$

in which $R_2$ represents a $C_{4-18}$ linear aliphatic hydrocarbon group; $C_{4-18}$ branched aliphatic hydrocarbon group, or $C_{6-18}$ aromatic hydrocarbon group, X represents a group $>NH$, $>N(CH_2)_{n1}COOM_2$, or $>CHCOOM_2$, $M_2$ represents a hydrogen atom, an alkali metal, an aliphatic amine having a $C_{1-4}$ carbon atom content, ammonia, or alkanolamine, and m1 and n1 independently indicate integers of 1–3, wherein the strong alkali (a) is present in an amount of 3–50 wt. %, the nonionic surface active agent (b) is present in an amount of 0.01–30 wt. %, and the solubilizing agent (c) is present in an amount of 0.01–30 wt. %.

2. The aqueous solution composition of a strong alkali and a nonionic surface active agent according to claim 1, wherein the pH of said aqueous solution composition is not less than 10.

3. The aqueous solution composition according to claim 1, wherein the strong alkali (a) is present in an amount of 5–30 wt. %, the nonionic surface active agent (b) is present in an amount of 0.1–10 wt. %, and the solubilizing agent (c) is present in amount of 0.1–20 wt. %.

4. The aqueous soltuion composition according to claim 1, wherein the ratio of the compound of formula (I)/(II) is 9/1–1/9.

5. The aqueous solution composition according to claim 3, wherein the ratio of the compound of formula (I)/(II) is 9/1–1/9.

6. The aqueous solution composition according to claim 1, wherein the ratio of the compounds of formula (I)/(II) is 7/3–3/7.

7. The aqueous solution composition according to claim 3, wherein the ratio of the compounds of formula (I)/(II) is 7/3–3/7.

* * * * *